US010361525B2

(12) United States Patent
Li et al.

(10) Patent No.: US 10,361,525 B2
(45) Date of Patent: Jul. 23, 2019

(54) CONNECTOR, CABLE HARNESS ASSEMBLY, VEHICLE CAN BUS CONNECTOR AND CONNECTION TERMINAL

(71) Applicants: Tyco Electronics (Shanghai) Co. Ltd., Shanghai (CN); Tyco Electronics Technology (SIP) Co. Ltd., Suzhou (CN)

(72) Inventors: Jianxiong Li, Shanghai (CN); Cancan Zhao, Shanghai (CN); Xueli Zou, Jiangsu (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/236,233

(22) Filed: Aug. 12, 2016

(65) Prior Publication Data

US 2017/0047696 A1 Feb. 16, 2017

(30) Foreign Application Priority Data

Aug. 14, 2015 (CN) ..... 2015 1 0500468
Aug. 14, 2015 (CN) ..... 2015 2 0614426 U

(51) Int. Cl.
*H01R 11/09* (2006.01)
*H01R 31/02* (2006.01)
(Continued)

(52) U.S. Cl.
CPC ..... *H01R 31/02* (2013.01); *H01R 13/04* (2013.01); *H01R 13/405* (2013.01); *H01R 25/003* (2013.01); *H01R 31/005* (2013.01)

(58) Field of Classification Search
CPC ..... H01R 9/24; H01R 9/2408; H01R 9/2433; H01R 9/245
(Continued)

(56) References Cited

U.S. PATENT DOCUMENTS 3,263,202 A * 7/1966 Dean ..... H01R 31/02 439/724
4,577,917 A * 3/1986 Nashimoto ..... B62J 6/001 439/36
5,908,322 A * 6/1999 Seki ..... H01R 9/2458 439/212

FOREIGN PATENT DOCUMENTS

CN 2773950 4/2006

OTHER PUBLICATIONS

English Translation of Office Action issued by the State Intellectual Property Office of the People's Republic of China, dated Apr. 10, 2018, f or Chinese patent application No. 201510500468.1; 6 pages.

* cited by examiner

*Primary Examiner* — Phuong K Dinh
(74) *Attorney, Agent, or Firm* — Faegre Baker Daniels LLP

(57) ABSTRACT

A first perspective of the invention relates to a connector, a cable harness assembly, and a vehicle CAN bus connector. The connector includes a housing and a metal connection terminal. The cable harness assembly includes multiple cables and the connector. The vehicle CAN bus connector includes the cable harness assembly. According to the invention, an input terminal and an output terminal are integrally disposed, saving the need of a printed circuit board, as such, a process of connecting terminals to a printed circuit board is eliminated. A second perspective of the invention relates to a connection terminal, a connector, a cable harness assembly, and a vehicle CAN bus connector. The connection terminal includes a terminal body and one or more shoulders, which are asymmetrically disposed on a surface of the terminal body and protrude therefrom, so that the connection terminal has an asymmetric structure in a direction perpendicular to the plug-in direction. The invention can prevent a
(Continued)

mold from being damaged by incorrect placement of the connection terminal.

21 Claims, 11 Drawing Sheets

(51) Int. Cl.
*H01R 13/04* (2006.01)
*H01R 13/405* (2006.01)
*H01R 25/00* (2006.01)
*H01R 31/00* (2006.01)

(58) Field of Classification Search
USPC ..... 439/723, 724, 635, 638, 721
See application file for complete search history.

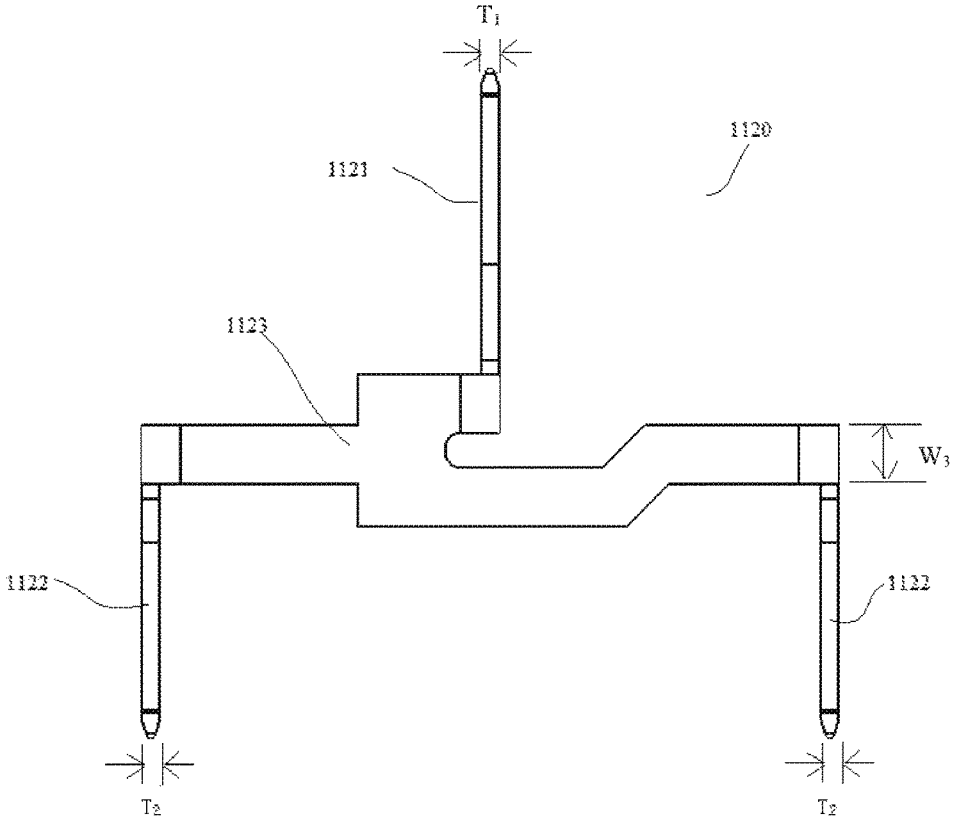
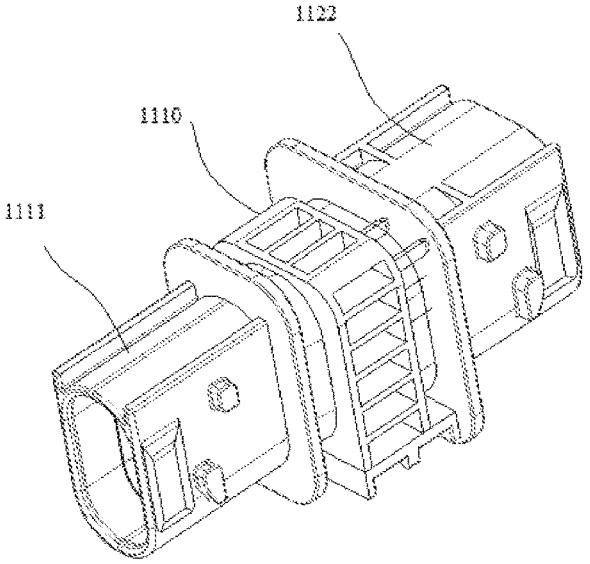
FIG. 1-8

CONNECTOR, CABLE HARNESS ASSEMBLY, VEHICLE CAN BUS CONNECTOR AND CONNECTION TERMINAL

CLAIM OF PRIORITY

The present application claims priority from Chinese patent applications CN 201510500468.1 and CN 201520614426.6, both filed Aug. 14, 2015; the subject matter of which is incorporated herein by reference.

TECHNICAL FIELD

The present invention relates to a connector, a cable harness assembly, a vehicle Controller Area Network (CAN) bus connector and a connection terminal.

BACKGROUND

Connectors are used a lot in vehicle circuits and communication transmission. A connector includes a housing and a connection terminal, and the connection terminal is disposed in the housing. One type of connector is Y-shaped. Each connection terminal includes one input terminal and two output terminals. The input terminal and the output terminals are all cylindrical. The input terminal is connected to the output terminals by using a printed circuit board. The input terminal and the output terminals are mechanically connected to the printed circuit board first. The input terminal is electrically connected to the two output terminals via circuit patterns on the printed circuit board, and by using the printed circuit board; the three terminals form a set of transmission signals. This kind of product has a complex structure and requires many parts, for example, a printed circuit board is a must. Using of the printed circuit board not only increases production costs, but also increases production process complexity. The input terminal and the output terminals have to be mechanically connected to the printed circuit board, and in addition, a welding process is further required. Welding has defects such as welding stress and faulty welding, which affects the effect of electrical connection.

FIG. 2-1 is an exploded view of the structure of one type of connector. FIG. 2-2 is a side view of a connection terminal in FIG. 2-1. The connector includes a housing 2210 and a connection terminal 2220. The connection terminal 2220 is disposed in the housing 2210. The connection terminal 2220 is in the shape of a flat sheet. During production, the connection terminal 2220 and the housing 2210 are combined through insert molding. Before injection molding, the metal connection terminal 2220 is placed and fixed in a cavity of an injection mold first, and then an injection molding material is injected into the cavity to perform the injection molding. The connection terminal 2220 includes an input terminal 2221, two output terminals 2222, and a connecting piece 2223. The two output terminals 2222 are connected to the input terminal 2221 through the connecting piece 2223. The input terminal 2221, the two output terminals 2222, and the connecting piece 2223 are integrally formed. The connection terminal 2220 is provided with shoulders 2224, for example, two shoulders 2224 disposed on the input terminal 2221. The two shoulders 2224 are disposed on an upper surface and a lower surface of the input terminal 2221 respectively. The two shoulders 2224 protrude from the input terminal 2221 to a same extent, and are the same in shape. When put the connection terminal 2220 into the cavity of the mold, because the two shoulders 2224 are symmetrically disposed on the input terminal 2221, no matter in correct orientation or in reverse orientation the connection terminal can be placed in the cavity. However, when in use, if the connection terminal 2220 is placed in reverse orientation, it will interfere with the mold core, thereby damaging the mold.

SUMMARY OF THE INVENTION

The present invention includes two parts. According to a first part, a connector, a cable harness assembly, and a vehicle CAN bus connector that are simple in structure are provided. According to a second part, a connection terminal, a connector, a vehicle CAN bus connector, and a cable harness assembly are provided.

According to a first perspective of the invention, a first objective is to provide a connector simple in structure, so as to eliminate defects in the prior art. The objective is achieved by using the following technical solutions:

A connector comprises a housing, which has an input plug-in interface and an output plug-in interfaces used for plug-in connection to a mating connector. The connector also comprises a metal connection terminal, which has one input terminal and multiple output terminals, which are connected to each other through an adapting piece. The metal connection terminal is mounted in the housing, and the input terminal and the output terminals are located in the input plug-in interface and the output plug-in interface respectively, and are used for plug-in connection to a mating connection terminal.

According to a preferred embodiment of the present invention, the metal connection terminal is an integrally formed piece.

According to a preferred embodiment of the present invention, the metal connection terminal and the housing are an insert-molded piece.

According to a preferred embodiment of the present invention, the input terminal, the output terminals and the adapting piece are each in the shape of a flat sheet.

According to a preferred embodiment of the present invention, the length of the input terminal is greater than the thickness and the width of the input terminal; the length of each output terminal is greater than the thickness and the width of the output terminal; and the extending direction of the width of the input terminal and the extending direction of the width of each output terminal are the same, and are same as the extending direction of the thickness of the adapting piece.

According to a preferred embodiment of the present invention, the input terminal is connected to a middle portion of the adapting piece, and the multiple output terminals are connected to the two ends of the adapting piece respectively.

According to a preferred embodiment of the present invention, the width of the adapting piece extends along a horizontal direction, and the widths of the input terminal and the output terminals extend along a vertical direction.

According to a preferred embodiment of the present invention, the input terminal, the adapting piece and the output terminals are integrally disposed, and are formed through bending.

According to a preferred embodiment of the present invention, the metal connection terminal is an integral piece formed by sheet stamping. The input terminal and the output terminals are bent relative to the adapting piece, and are disposed to be perpendicular to the adapting piece.

According to a preferred embodiment of the present invention, the connector comprises multiple metal connection terminals, and the respective adapting pieces of the multiple metal connection terminals are disposed to be parallel with each other; and ends of the respective input terminals of the multiple metal connection terminals are aligned.

According to a preferred embodiment of the present invention, the multiple metal connection terminals are the same.

According to a preferred embodiment of the present invention, the connector comprises three metal connection terminals, which are used for connection to a positive electrode, a negative electrode and a shield respectively.

According to a preferred embodiment of the present invention, the housing is provided with one output plug-in interface; the metal connection terminal includes one input terminal and two output terminals; and the two output terminals are located in the one output plug-in interface.

According to a preferred embodiment of the present invention, the connector comprises multiple metal connection terminals, and the respective multiple output terminals of the multiple metal connection terminals are located in the one output plug-in interface.

According to a preferred embodiment of the present invention, the housing is provided with two output plug-in interfaces; and the metal connection terminal includes one input terminal and two output terminals, and the two output terminals are located in the two output plug-in interfaces respectively.

According to a preferred embodiment of the present invention, the connector comprises multiple metal connection terminals, and the output terminals of each metal connection terminal are located in the two output plug-in interfaces respectively.

According to a preferred embodiment of the present invention, the input plug-in interface and the output plug-in port have same plug-in mating structure used for mating with same mating connectors.

A second objective of the first perspective of the present invention is to provide a cable harness assembly simple in structure, so as to eliminate defects in the prior art. The objective is achieved by using the following technical solution:

A cable harness assembly including multiple cables and the foregoing connector, wherein the multiple cables are connected to the input terminal and the output terminals respectively.

A third objective of the first perspective of the present invention is to provide a vehicle CAN bus connector simple in structure, so as to eliminate defects in the prior art. The objective is achieved by using the following technical solution:

A vehicle CAN bus connector is provided having the foregoing cable harness assembly.

According to the connector, the cable harness assembly, and the vehicle CAN bus connector of the present invention, an input terminal and output terminal are integrally disposed, saving the need of a printed circuit board, as such, not only the structure is simple and production costs are low, but also a process of connecting terminals to a printed circuit board is eliminated, and thereby production is easy. Especially, the input terminal and the output terminal in the present invention do not need to be welded, and therefore the production process is greatly simplified. The input terminal, the output terminal and an adapting piece are integrally disposed, and therefore can be produced by means of stamping and bending only. The connector is applicable to a variety of application occasions, for example, an occasion in which one input terminal works with multiple output terminals, and is widely applicable.

According to a second perspective of the invention, a first objective of this part of the present invention is to provide a connection terminal that can prevent wrong placement, so as to eliminate defects in the prior arts. The objective is achieved by using the following technical solutions:

A connection terminal comprises a terminal body, which has a symmetric structure in a direction perpendicular to a plug-in direction of the connection terminal. The connection terminal also has one or more shoulders, which are asymmetrically disposed on a surface of the terminal body and protrude therefrom, so that the connection terminal is of an asymmetric structure in the direction perpendicular to the plug-in direction.

According to a preferred embodiment of the present invention, the one or more shoulders are disposed on one surface of the terminal body.

According to a preferred embodiment of the present invention, the connection terminal comprises multiple shoulders, and the multiple shoulders are the same and are disposed in asymmetric positions on different surfaces of the terminal body.

According to a preferred embodiment of the present invention, that the multiple shoulders are the same refers to that the multiple shoulders are the same in shape and size.

According to a preferred embodiment of the present invention, the connection terminal comprises multiple shoulders, and the multiple shoulders are different and are disposed on different surfaces of the terminal body.

According to a preferred embodiment of the present invention, that the multiple shoulders are different refers to that the multiple shoulders are different in shape or size, or are different in both shape and size.

According to a preferred embodiment of the present invention, the terminal body has an upper surface, a lower surface, a left side surface, and a right side surface that are parallel with the direction of a length L, and the one or more shoulders are disposed on one or more surfaces among the upper surface, the lower surface, the left side surface, and the right side surface.

According to a preferred embodiment of the present invention, the terminal body has one input terminal and multiple output terminals, which are connected to each other through an adapting piece; and the input terminal or the output terminals are provided with the one or more shoulders, or the input terminal and the output terminals are each provided with the one or more shoulders.

According to a preferred embodiment of the present invention, the input terminal has an upper surface, a lower surface, a left side surface, and a right side surface that are parallel with the direction of the length L, and the one or more shoulders are disposed on one or more surfaces among the upper surface, the lower surface, the left side surface, and the right side surface of the input terminal.

According to a preferred embodiment of the present invention, the one or more shoulders include a first shoulder and a second shoulder which are disposed on the upper surface and the lower surface of the input terminal respectively, and are different in shape or size, or are different in both shape and size.

According to a preferred embodiment of the present invention, each output terminal has an upper surface, a lower surface, a left side surface, and a right side surface that are parallel with the direction of the length L, and the one or more shoulders are disposed on one or more surfaces among the upper surface, the lower surface, the left side surface, and the right side surface of the output terminal.

According to a preferred embodiment of the present invention, the one or more shoulders include a third shoulder and a fourth shoulder, which are disposed on the upper surface and the lower surface of the output terminal respectively, and are different in shape or size, or are different in both shape and size.

According to a preferred embodiment of the present invention, the input terminal, the output terminals and the adapting piece are each in the shape of a flat sheet.

According to a preferred embodiment of the present invention, the width of the adapting piece extends along a horizontal direction, and the widths of the input terminal and the output terminals extend along a vertical direction.

According to a preferred embodiment of the present invention, the input terminal is connected to a middle portion of the adapting piece, and the multiple output terminals are connected to the two ends of the adapting piece respectively.

According to a preferred embodiment of the present invention, the connection terminal is an integrally formed piece.

A second objective of the second perspective of the invention is to provide a connector that can prevent wrong placement of a connection terminal, so as to eliminate defects in the prior arts. The objective is achieved by using the following technical solutions:

A connector comprises a housing, which has an input plug-in interface and an output plug-in interfaces used for plug-in connection to a mating connector. The foregoing connection terminal, wherein the connection terminal is mounted in the housing; the connection terminal has one input terminal and multiple output terminals, which are located in the input plug-in interface and the output plug-in interface of the housing respectively, and are used for plug-in connection to a mating connection terminal.

According to a preferred embodiment of the present invention, the connection terminal and the housing are an integrally insert-molded piece.

A third objective of the second perspective of the invention is to provide a vehicle CAN bus connector that can prevent wrong placement of a connection terminal, so as to eliminate defects in the prior arts. The objective is achieved by using the following technical solution:

A vehicle CAN bus connector comprises the foregoing connector and multiple cables, wherein the multiple cables are connected to multiple connection terminals respectively.

A fourth objective of the second perspective of the invention is to provide a cable harness assembly that can prevent wrong placement of a connection terminal, so as to eliminate defects in the prior arts. The objective is achieved by using the following technical solution:

A cable harness assembly comprises multiple cables and the foregoing connection terminal, wherein the multiple cables are connected to the input terminal and the output terminals respectively.

According to the connection terminal, the connector, the cable harness assembly, and the vehicle CAN bus connector provided by the present invention, an input terminal and output terminals are integrally disposed, saving the need of a printed circuit board, as such, not only the structure is simple and production costs are low, but also a process of connecting terminals to a printed circuit board is eliminated, and thereby production is easy. Especially, the input terminal and the output terminal in the present invention do not need to be welded, and therefore a production process is greatly simplified. The input terminal, the output terminal and an adapting piece are integrally disposed, and therefore can be produced by means of stamping and bending only. The connector is applicable to a variety of application occasions, for example, an occasion in which one input terminal works with multiple output terminals, and is widely applicable. One or more shoulders are asymmetrically disposed on the connection terminal, and one or more grooves matching the one or more shoulder are disposed on a mold. When placement is correct, the one or more shoulders re embedded in the corresponding one or more grooves, and the connection terminal can be placed in position. When the connection terminal is placed in a wrong direction, the one or more shoulders cannot mate with the corresponding one or more grooves, and the connection terminal cannot be placed in position. The present invention can prevent a mold from being damaged by wrong placement of the connection terminal, thereby reducing risk of damaging the mold and enabling safer use. The shoulders are respectively disposed on the input terminal and the output terminal, so that the connection terminal is better balanced. Disposing the one or more shoulders can further facilitate positioning of the connection terminal during placement. A first shoulder and a second shoulder are disposed on an upper surface and a lower surface of the input terminal respectively, so that punching is easier.

BRIEF DESCRIPTION OF DRAWINGS

The following description is set forth in connection with the attached drawing figures, which are not necessarily to scale, emphasis instead generally being placed upon illustrating the principles of the invention. In the drawing figures:

FIG. 1-2 is an exploded view of the structure of the connector according to Embodiment 1 of the present invention;

FIG. 1-3 is a schematic left view of the connector in FIG. 1-1;

FIG. 1-4 is a schematic right view of the connector in FIG. 1-1;

FIG. 1-5 is a schematic structural view of a metal connection terminal of the invention;

FIG. 1-6 is a schematic front view of the metal connection terminal in FIG. 1-5;

FIG. 1-7 is a schematic bottom view of the metal connection terminal in FIG. 1-5;

FIG. 1-8 is a schematic structural view of a connector according to Embodiment 2 of the present invention;

FIG. 1-9 is a right view of the connector in FIG. 1-8;

FIG. 2-1 is an exploded view of the structure of one type of connector;

FIG. 2-2 is a side view of a connection terminal in FIG. 2-1;

FIG. 2-3 is a schematic structural view of the connector according to Embodiment 3 of the present invention;

FIG. 2-4 is a schematic exploded view of the structure of the connector according to Embodiment 3 of the present invention;

FIG. 2-5 is a front view of the connector in FIG. 2-3;

FIG. 2-6 is a schematic structural view of a connection terminal of the invention;

FIG. 2-7 is a schematic side view of the connection terminal in FIG. 2-6; and FIG. 2-8 is a schematic bottom view of the connection terminal in FIG. 2-6.

DETAILED DESCRIPTION OF EMBODIMENTS

The present invention is described in detail below with reference to the accompanying drawings.

Embodiment 1

Figure 1:
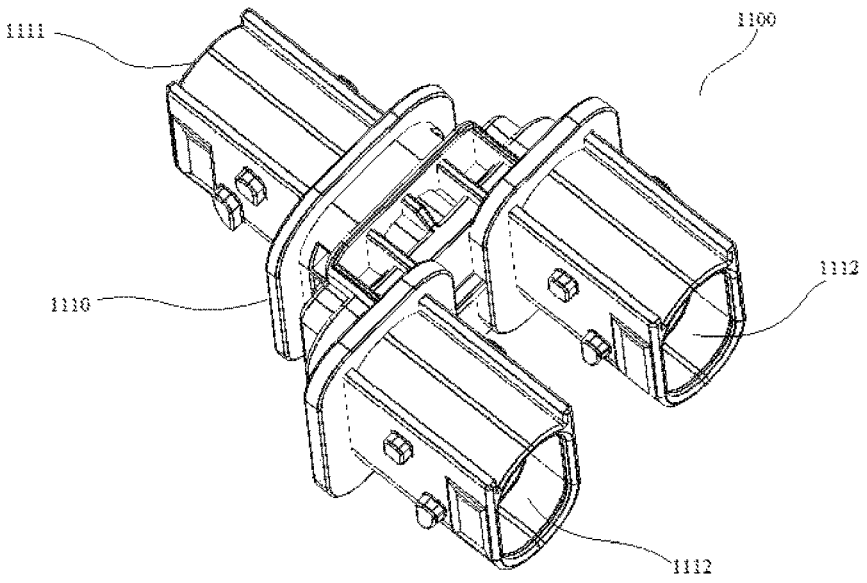
FIG. 1-1 is a schematic structural view of a connector according to Embodiment 1 of the present invention.
Figures 1, 2:
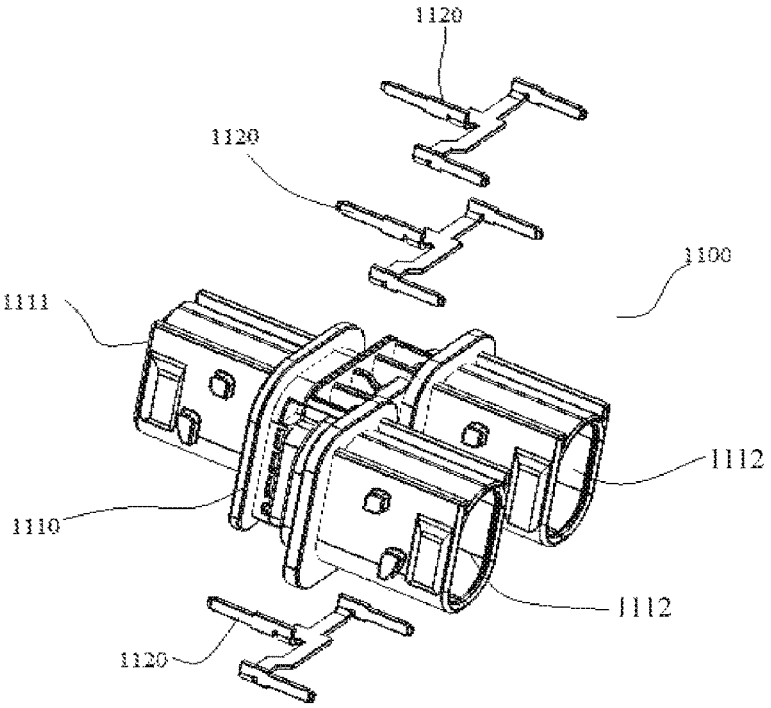
Figures 1, 2, 3:
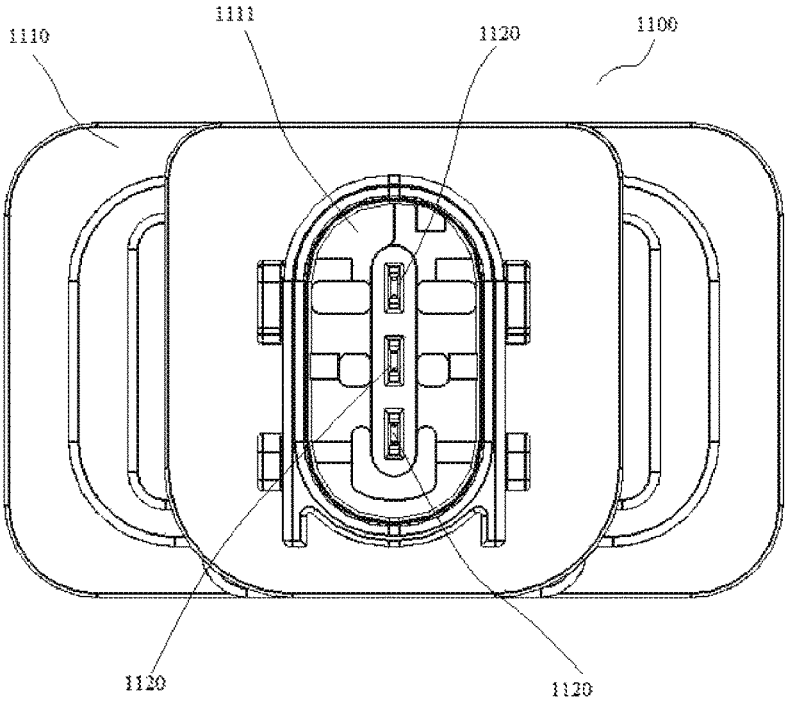
Figures 1, 2, 3, 4:
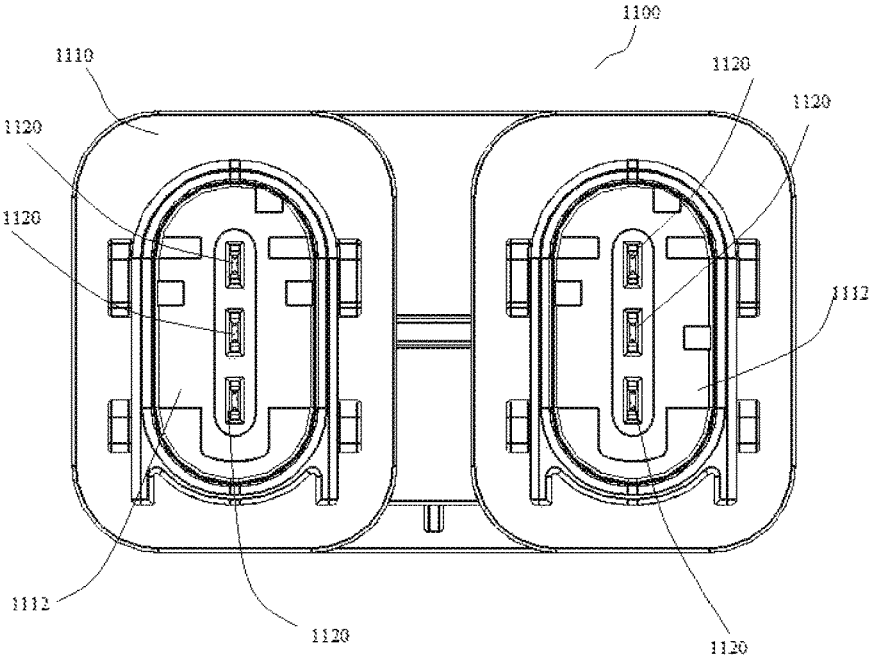

As shown in FIG. 1-1 to FIG. 1-4, a connector 1100 includes a housing 1110 and a metal connection terminal 1120. The metal connection terminal 1120 is disposed in the housing 1110. The housing 1110 has a plug-in interface used for plug-in connection to a mating connector. The number of the plug-in interfaces is determined according to application occasions. In a preferred example shown in the drawings, there are three plug-in interfaces, including one input plug-in interface 1111 and two output plug-in interfaces 1112. Relative positions of the one input plug-in interface 1111 and the two output plug-in interfaces 1112 can be determined according to actual needs, and can be, for example, in a Y-shaped distribution. The metal connection terminal 1120 has an input terminal and an output terminal. The number of the input terminals and the number of the output terminals are determined according to application occasions. In the preferred example shown in the drawings, the metal connection terminal 1120 has one input terminal 1121 and two output terminals 1122. Relative positions of the one input terminal 1121 and the two output terminals 1122 can be determined according to application occasions and match the three plug-in interfaces, and can be, for example, in a Y-shaped distribution. The metal connection terminal 1120 is disposed in the housing 1110 with the input terminal 1121 located in the input plug-in interface 1111, and the two output terminals 1122 located in the two output plug-in interfaces 1112 respectively. The metal connection terminal 1120 is used for plug-in connection to a mating connection terminal, so as to implement electrical connection or communication connection. In the preferred example shown in the drawings, there are three metal connection terminals 1120, which are arranged in parallel along the up-down direction in the housing 1110, and ends of the three metal connection terminals 1120 are aligned. The three metal connection terminals 1120 are the same in structure, and are used for connection to a positive electrode, a negative electrode and a shield respectively. The metal connection terminal 1120 and the housing 1110 are formed through insert molding with the metal connection terminal 1120 disposed in the housing 1110.

Figures 1, 2, 3, 4, 5:
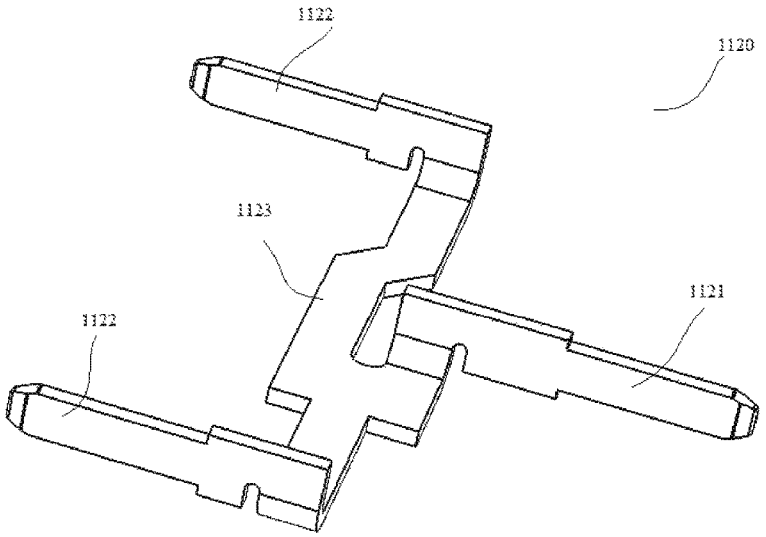
Figures 1, 2, 3, 4, 5, 6:
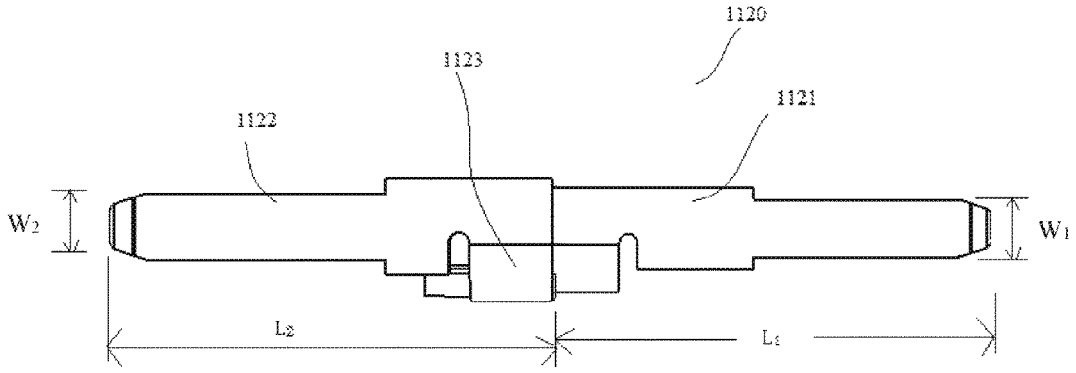
Figures 1, 2, 3, 4, 5, 6, 7:
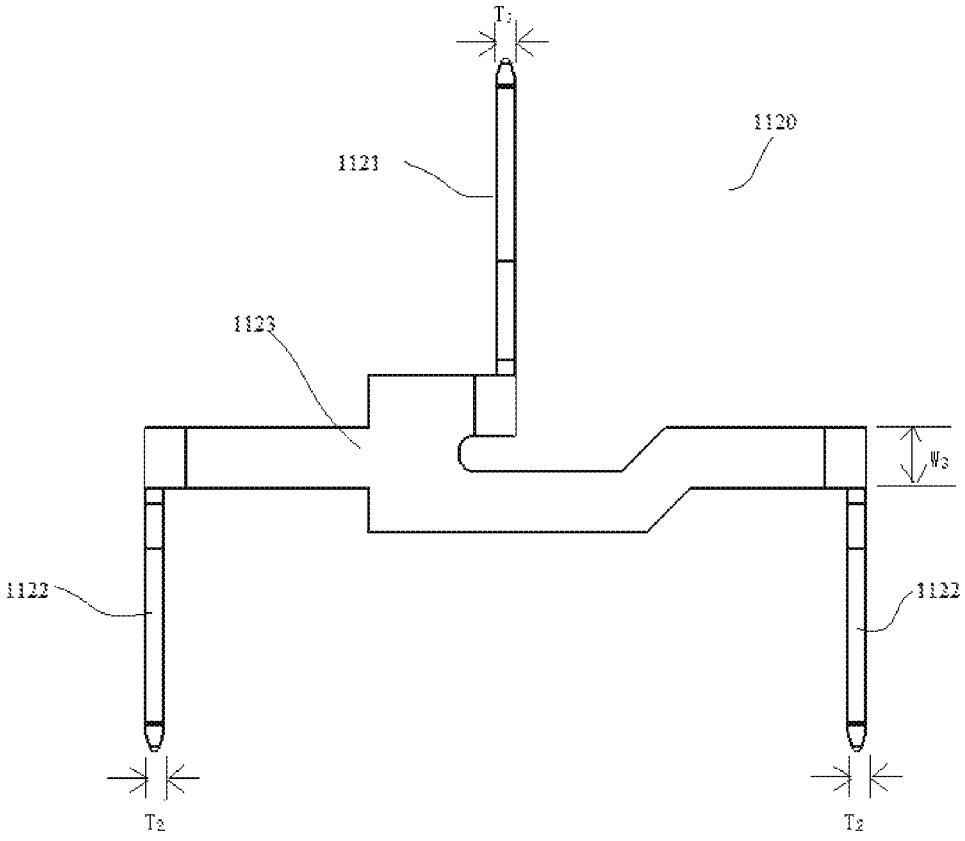

As shown in FIG. 1-5 to FIG. 1-7, according to a preferred embodiment of the present invention, the metal connection terminal 1120 includes one input terminal 1121, two output terminals 1122, and one adapting piece 1123. One end of the input terminal 1121 is connected to a middle portion of the adapting piece 1123 and the two output terminals 1122 are connected to the two ends of the adapting piece 1123 respectively. The one input terminal 1121 and the two output terminals 1122 are in a Y-shaped distribution.

The input terminal 1121 and the output terminals 1122 are each in the shape of a flat sheet. The length $L_1$ of the input terminal 1121 is greater than the thickness $T_1$ and the width $W_1$ of the input terminal 1121. The length $L_2$ of each output terminal 1122 is greater than the thickness $T_2$ and the width $W_2$ of the output terminal 1122. The extending direction of the width $W_1$ of the input terminal 1121 and the extending direction of the width $W_2$ of each output terminal 1122 are the same, and are same as the direction of the thickness of the adapting piece 1123. The direction of the thickness of the adapting piece 1123 is a direction perpendicular to the paper as shown in FIG. 1-7. The extending direction of the width $W_1$ of the input terminal 1121 and the extending direction of the width $W_2$ of each output terminal 1122 are both perpendicular to the extending direction of the width $W_3$ of the adapting piece 1123. In a preferred example shown in FIG. 1-6, the width $W_3$ of the adapting piece 1123 extends along a horizontal direction, and the widths of the input terminal 1121 and the output terminals 1122 extend along a vertical direction. The metal connection terminal 1120 is an integral piece formed by sheet stamping. The input terminal 1121 and the output terminals 1122 are bent relative to the adapting piece 1123 and are disposed to be perpendicular to the adapting piece 1123.

According to the connector provided by the present invention, an input terminal and an output terminal are integrally disposed, saving the need of a printed circuit board, as such, not only the structure is simple and production costs are low, but also a process of connecting terminals to a printed circuit board is eliminated, and thereby production is easy. Especially, the input terminal and the output terminal in the present invention do not need to be welded, and therefore the production process is greatly simplified. The input terminal, the output terminal, and an adapting piece are integrally disposed, and therefore can be produced by means of stamping and bending only. The connector is applicable to a variety of application occasions, for example, an occasion in which one input terminal works with multiple output terminals, and is widely applicable. Especially when the connector is used as a vehicle CAN bus connector, costs are reduced, and production and maintenance are easy.

Embodiment 2

Figures 1, 2, 3, 4, 5, 6, 7, 8, 9:
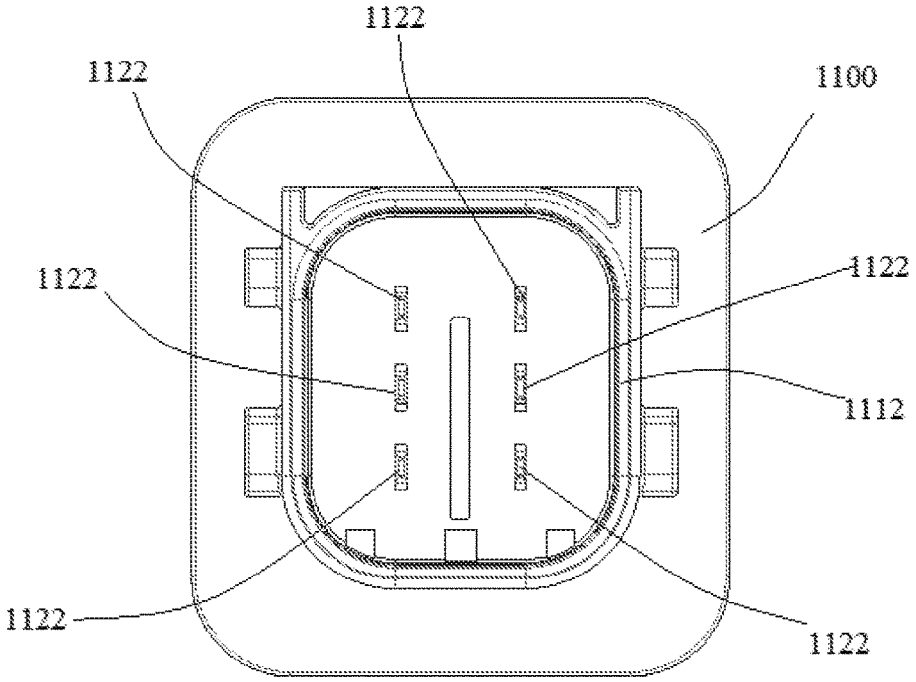
Figures 1, 2:
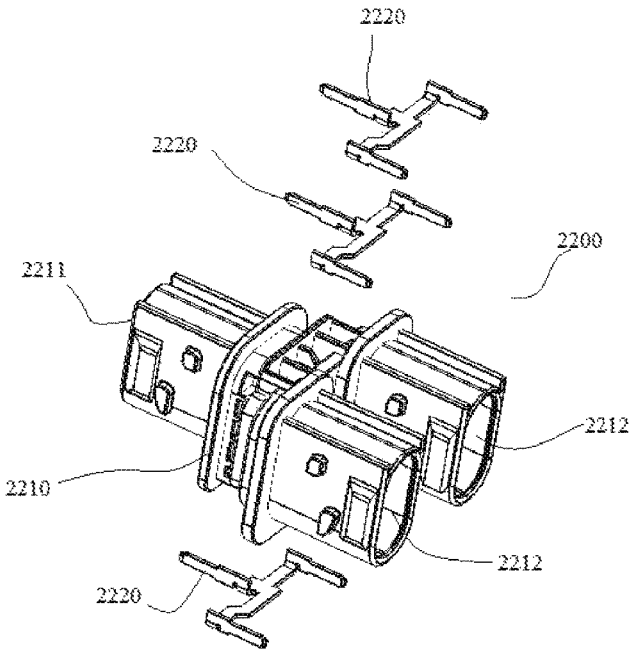
Figure 2:
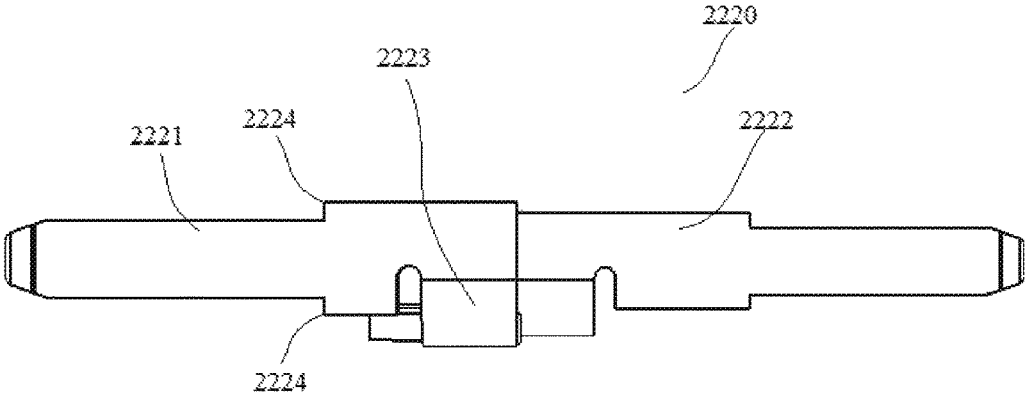
Figures 2, 3:
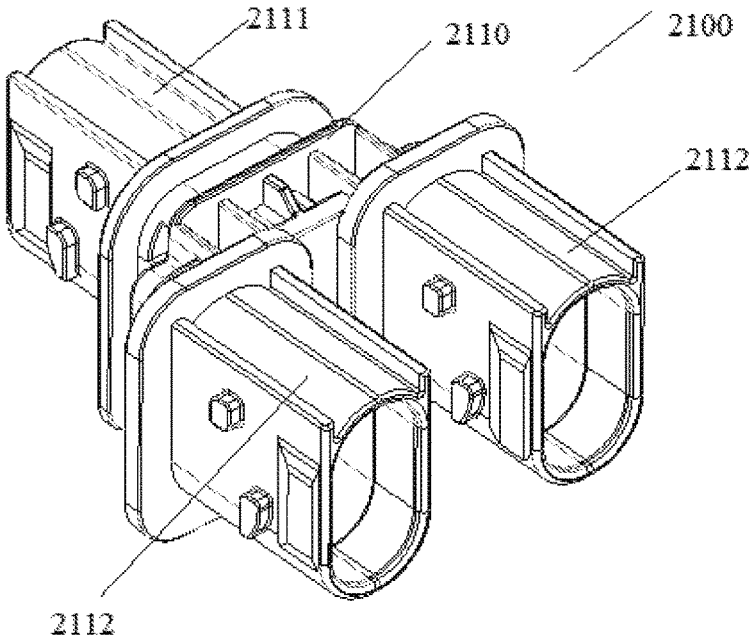
Figures 2, 3, 4:
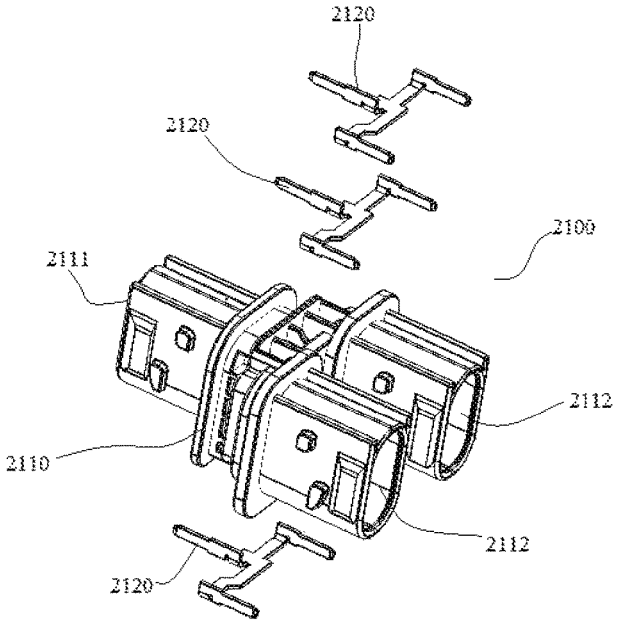
Figures 2, 3, 4, 5:
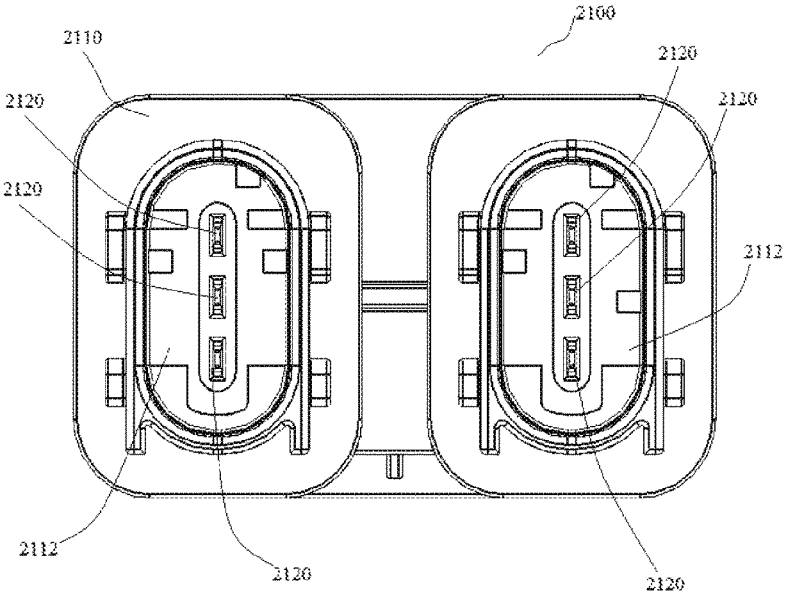
Figures 2, 3, 4, 5, 6:
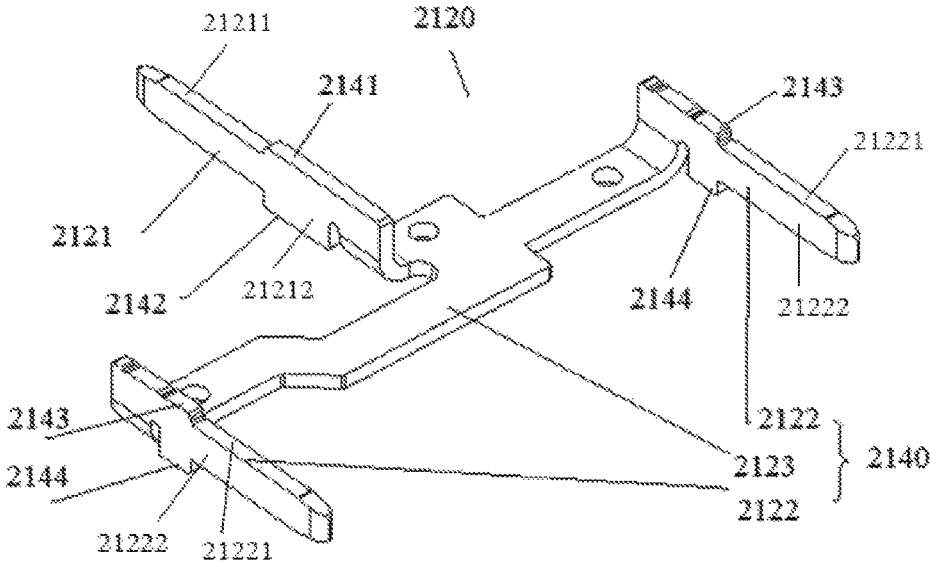
Figures 2, 3, 4, 5, 6, 7:
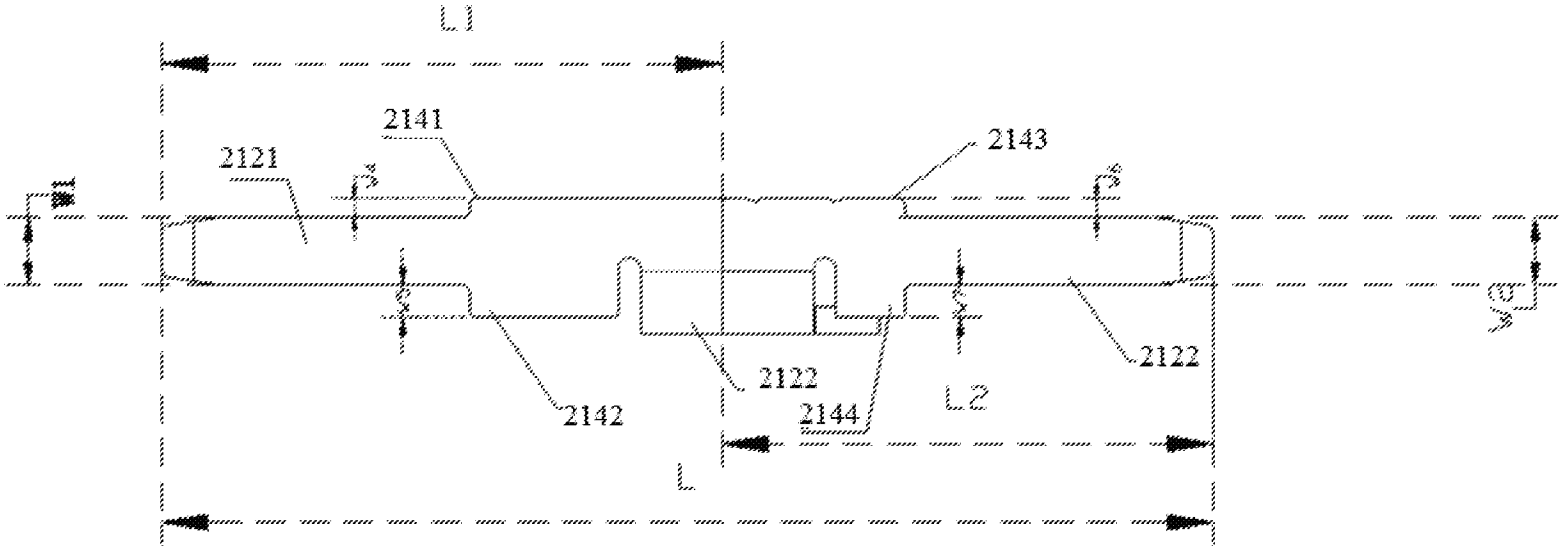
Figures 2, 3, 4, 5, 6, 7, 8:
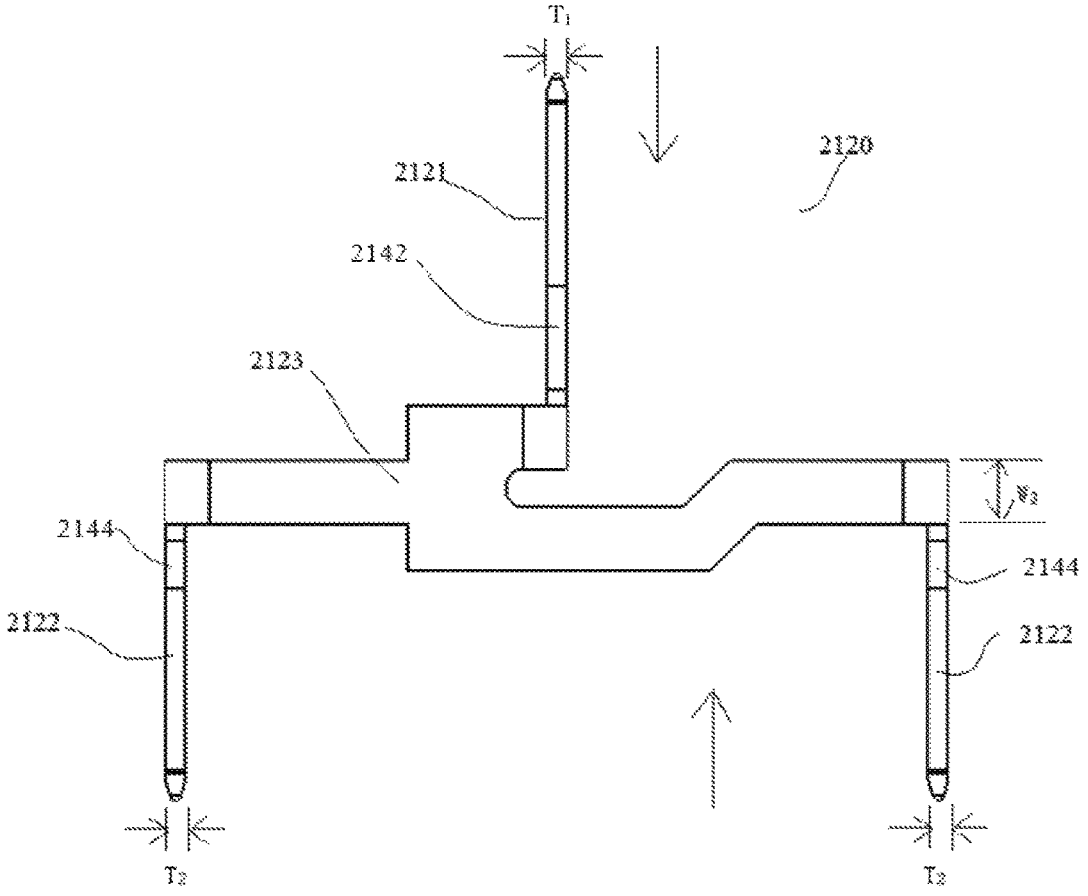

As shown in FIG. 1-8 to FIG. 1-9, a connector 1100 includes a housing 1110 and a metal connection terminal 1120. The metal connection terminal 1120 is disposed in the housing 1110. The housing 1110 has a plug-in interface used for plug-in connection to a mating connector. The number of the plug-in interfaces is determined according to application occasions. In a preferred example shown in the drawings, there are two plug-in interfaces, including one input plug-in interface 1111 and one output plug-in interface 1112. An opening of the input plug-in interface 1111 is arranged facing away from an opening of the output plug-in interface 1112. The metal connection terminal 1120 has an input terminal 1121 and an output terminal 1122. The number of the input terminals 1121 and the number of the output terminals 1122 are determined according to application occasions. In the preferred example shown in the drawings, the metal connection terminal 1120 has one input terminal 1121 and two output terminals 1122. Relative positions of the one input terminal 1121 and the two output terminals 1122 can be determined according to application occasions, and can be, for example, in a Y-shaped distribution. The metal connection terminal 1120 is disposed in the housing 1110 with the input terminal 1121 located in the input plug-in interface 1111 and the two output terminals 1122 located in the one output plug-in interface 1112. The metal connection terminal 1120 is used for plug-in connection to a mating connection terminal, so as to implement electrical connection or communication connection. In the preferred example shown in the drawings, there are three metal connection terminals 1120 arranged in parallel along the up-down direction in the housing 1110. The three metal connection terminals 1120 are the same in structure, and are used for connection to a positive electrode, a negative electrode and a shield respectively. The metal connection terminal 1120 and the housing 1110 are formed through insert molding with the metal connection terminal 1120 disposed in the housing 1110.

As shown in FIG. 1-5 to FIG. 1-7, according to a preferred embodiment of the present invention, the metal connection terminal 1120 includes one input terminal 1121, two output terminals 1122 and one adapting piece 1123. One end of the input terminal 1121 is connected to a middle portion of the adapting piece 1123 and the two output terminals 1122 are connected to the two ends of the adapting piece 1123 respectively. The one input terminal 1121 and the two output terminals 1122 are in a Y-shaped distribution.

The input terminal 1121 and the output terminals 1122 are each in the shape of a flat sheet. The length $L_1$ of the input terminal 1121 is greater than the thickness $T_1$ and the width $W_1$ of the input terminal 1121. The length $L_2$ of each output terminal 1122 is greater than the thickness $T_2$ and the width $W_2$ of the output terminal 1122. The extending direction of the width $W_1$ of the input terminal 1121 and the extending direction of the width $W_2$ of each output terminal 1122 are the same. The extending direction of the width $W_1$ of the input terminal 1121 and the extending direction of the width $W_2$ of each output terminal 1122 are both perpendicular to the extending direction of the width $W_3$ of the adapting piece 1123. In a preferred example shown in FIG. 1-6, the width $W_3$ of the adapting piece 1123 extends along a horizontal direction, and the widths of the input terminal 1121 and the output terminals 1122 extend along a vertical direction. The metal connection terminal 1120 is an integral piece formed by sheet stamping. The input terminal 1121 and the output terminals 1122 are bent relative to the adapting piece 1123 and are disposed to be perpendicular to the adapting piece 1123.

In this embodiment, there is only one output plug-in interface, in which the six output terminals 1122 of the three metal connection terminals are all located, so that the structure is simpler, and production is easier.

A cable harness assembly can be formed by combining multiple cables and the connector in Embodiment 1 or 2. The multiple cables are electrically connected to the input terminal and the output terminals respectively, thereby implementing a function of power transmission or a communication signal.

The cable harness assembly can be used for a vehicle CAN bus.

Embodiment 3

As shown in FIG. 2-3 to FIG. 2-5, a connector 2100 includes a housing 2110 and a connection terminal 2120. The connection terminal 2120 is made of metal or other electrically conductive materials. The connection terminal 2120 is disposed in the housing 2110. The housing 2110 has a plug-in interface used for plug-in connection to a mating connector. The number of the plug-in interfaces is determined according to application occasions. In a preferred example shown in the drawings, there are three plug-in interfaces, including one input plug-in interface 2111 and two output plug-in interfaces 2112. Relative positions of the one input plug-in interface 2111 and the two output plug-in interfaces 2112 can be determined according to actual needs, and can be, for example, in a Y-shaped distribution.

As shown in FIG. 2-6 to FIG. 2-8, according to a preferred embodiment of the present invention, the connection terminal 2120 includes a terminal body 2140. The terminal body 2140 includes an input terminal, an output terminal, and an adapting piece. The number of the input terminals and the number of the output terminals are determined according to application occasions. In the preferred example shown in the drawings, the terminal body 2140 has one input terminal 2121, two output terminals 2122, and one adapting piece 2123. Relative positions of the one input terminal 2121 and the two output terminals 2122 can be determined according to application occasions and match the three plug-in interfaces, and can be, for example, in a Y-shaped distribution. One end of the input terminal 2121 is connected to a middle portion of the adapting piece 2123 and the two output terminals 2122 are connected to the two ends of the adapting piece 2123 respectively. The one input terminal 2121 and the two output terminals 2122 are in a Y-shaped distribution. The connection terminal 2120 is disposed in the housing 2110 with the input terminal 2121 located in the input plug-in interface 2111, and the two output terminals 2122 located in the two output plug-in interfaces 2112 respectively. The connection terminal 2120 is used for plug-in connection to a mating connection terminal, so as to implement electrical connection or communication connection. In the preferred example shown in the drawings, there are three connection terminals 2120 arranged in parallel along the up-down direction in the housing 2110. The three connection terminals 2120 are the same in structure, and are used for connection to a positive electrode, a negative electrode and a shield respectively. The connection terminal 2120 and the housing 2110 are formed through insert molding with the connection terminal 2120 disposed in the housing 2110.

The input terminal 2121 and the output terminals 2122 are each in the shape of a flat sheet. The length $L_1$ of the input terminal 2121 is greater than the thickness $T_1$ and the width $W_1$ of the input terminal 2121. The length $L_2$ of each output terminal 2122 is greater than the thickness $T_2$ and the width $W_2$ of the output terminal 2122. The extending direction of the width $W_1$ of the input terminal 2121 and the extending direction of the width $W_2$ of each output terminal 2122 are the same, and are same as the direction of the thickness of the adapting piece 2123. The direction of the thickness of the adapting piece 2123 is a direction perpendicular to the paper as shown in FIG. 2-8. The extending direction of the width $W_1$ of the input terminal 2121 and the extending direction of the width $W_2$ of each output terminal 2122 are both perpendicular to the extending direction of the width $W_3$ of the adapting piece 2123. The extending direction of the width $W_1$ of the input terminal 2121 and the extending direction of the width $W_2$ of each output terminal 2122 are a vertical direction in FIG. 2-7, which is a side view. The extending direction of the width $W_3$ of the adapting piece 2123 is a vertical direction shown in FIG. 2-8, which is a bottom view.

As shown in FIG. 2-8, the terminal body 2140 is of a symmetric structure in the direction perpendicular to the plug-in direction. The plug-in direction of the input terminal 2121 and the plug-in direction of the output terminals 2122 are opposite to each other, as shown by arrows in FIG. 2-8. As shown in FIG. 2-6 to FIG. 2-8, the connection terminal 2120 further includes a shoulder. The shoulder is asymmetrically disposed on a surface of the terminal body 2140, and protrudes therefrom, so that the connection terminal is of an asymmetric structure in the direction perpendicular to the plug-in direction. The asymmetry structure refers to that one or more shoulders are disposed on one surface of the terminal body 2140; or, there are multiple shoulders, which are the same in shape and size, but are disposed in asymmetric positions on different surfaces of the terminal body;

or, there are multiple shoulders, which are different in shape or size, or different in both shape and size, and are disposed in asymmetric positions or symmetric positions on different surfaces of the terminal body. In a preferred example shown in FIG. 2-6 to FIG. 2-8, there are multiple shoulders, which are the same in shape but different in size, and are disposed in symmetric positions on different surfaces of the terminal body. The input terminal 2121 has an upper surface 21211, a lower surface (not shown in the drawings), a left side surface 21212, and a right side surface (not shown in the drawings) that are parallel with the direction of a length L. The shoulders include a first shoulder 2141 and a second shoulder 2142, which are disposed on the upper surface 21211 and the lower surface of the input terminal respectively. The width $W_4$ of the first shoulder 2141 is less than the width $W_5$ of the second shoulder 2142. That is, the extent to which the first shoulder 2141 protrudes from the upper surface 21211 of the input terminal is less than the extent to which the second shoulder 2142 protrudes from the lower surface of the input terminal. Each output terminal 2122 has an upper surface 21221, a lower surface (not shown in the drawings), a left side surface 21222, and a right side surface (not shown in the drawings) that are parallel with the direction of the length L. The shoulders further include a third shoulder 2143 and a fourth shoulder 2144 which are disposed on the upper surface 21221 and the lower surface of the output terminal respectively. The width $W_6$ of the third shoulder 2143 is less than the width $W_7$ of the fourth shoulder 2144. That is, the extent to which the third shoulder 2143 protrudes from the upper surface 21221 of an output terminal is less than the extent to which the fourth shoulder 2144 protrudes from the lower surface of the output terminal. The shoulder asymmetrically disposed on an upper surface, a lower surface, a left side surface, or a right side surface of the terminal body enables the connection terminal to be of an asymmetric structure in the direction perpendicular to the plug-in direction.

The connection terminal 2120 is an integral piece formed by sheet punching. The input terminal 2121 and the output terminals 2122 are bent relative to the adapting piece 2123, and are disposed to be perpendicular to the adapting piece 2123.

A cable harness assembly can be formed by combining multiple cables and the connector. The multiple cables are electrically connected to the input terminal and the output terminals respectively, thereby implementing a function of power transmission or a communication signal. The cable harness assembly can be used for a vehicle CAN bus.

According to the connector provided by the present invention, an input terminal and an output terminal are integrally disposed, saving the need of a printed circuit board, as such, not only the structure is simple, and production costs are low, but also a process of connecting terminals to a printed circuit board is eliminated, and thereby production is easy. Especially, the input terminal and the output terminal in the present invention do not need to be welded, and therefore the production process is greatly simplified. The input terminal, the output terminal, and an adapting piece are integrally disposed, and therefore can be produced by means of stamping and bending only. The connector is applicable to a variety of application occasions, for example, an occasion in which one input terminal works with multiple output terminals, and is widely applicable. Especially when the connector is used as a vehicle CAN bus connector, costs are reduced, and production and maintenance are easy. One or more shoulders are asymmetrically disposed on the connection terminal; and one or more grooves matching the one or more shoulders are disposed on a mold. When placement is correct, the one or more shoulders are embedded in the corresponding one or more grooves, and the connection terminal can be placed in position. When the connection terminal is placed in a wrong direction, the one or more shoulders cannot mate with the corresponding one or more grooves, and the connection terminal cannot be placed in position. The present invention can prevent the mold from being damaged by wrong placement of the connection terminal, thereby reducing risk of damaging the mold and enabling safer use. The shoulders are respectively disposed on the input terminal and the output terminal, so that the connection terminal is better balanced. Disposing the one or more shoulders can further facilitate positioning of the connection terminal during placement. A first shoulder and a second shoulder are disposed on an upper surface a lower surface of the input terminal respectively, so that punching is easier.

Throughout the description and claims of this specification, the singular encompasses the plural unless the context otherwise requires. In particular, where the indefinite article is used, the specification is to be understood as contemplating plurality as well as singularity, unless the context requires otherwise.

The embodiments of the present invention are for illustration purpose only and are not intended to limit the scope of the claims. Any substantially equivalent replacement of the embodiments described herein that will occur to a person skilled in the art falls within the protection scope of the present invention.

What is claimed is:

1. A connector, comprising:

a housing, which has an input plug-in interface and an output plug-in interface for plug-in connection to a mating connector; and a metal connection terminal comprising one input terminal and multiple output terminals which are connected to each other through an adapting piece, the metal connection terminal comprising a terminal body, which has a symmetric structure in a direction perpendicular to a plug-in direction of the metal connection terminal, and one or more shoulders, which are asymmetrically disposed on a surface of the terminal body and protrude therefrom, so that the metal connection terminal has an asymmetric structure in a direction perpendicular to the plug-in direction;

wherein the metal connection terminal is mounted in the housing, and wherein the input terminal and the output terminals are located in the input plug-in interface and the output plug-in interface, respectively, for plug-in connection to a mating connection terminal.

2. The connector according to claim 1, wherein the one or more shoulders are disposed on one surface of the terminal body.

3. The connector according to claim 2, wherein the metal connection terminal comprises multiple shoulders, which are disposed in asymmetric positions on different surfaces of the terminal body; and the multiple shoulders are the same in shape and size.

4. The connector according to claim 2, wherein the metal connection terminal comprises multiple shoulders, which are disposed on different surfaces of the terminal body; and the multiple shoulders are different in shape or size, or both shape and size.

5. The connector according to claim 2, wherein the terminal body has an upper surface, a lower surface, a left side surface, and a right side surface, which are parallel with a direction of length L; and the one or more shoulders are disposed on one or more of the upper surface, the lower surface, the left side surface, and the right side surface.

6. The connector according to claim 2, wherein the terminal body has one input terminal and multiple output terminals, which are connected to each other through an adapting piece; and at least one of the input terminal and the output terminals is provided with the one or more shoulders.

7. The connector according to claim 6, wherein the input terminal has an upper surface, a lower surface, a left side surface, and a right side surface, which are parallel with a direction of length L; the one or more shoulders are disposed on at least one of the upper surface, the lower surface, the left side surface, and the right side surface of the input terminal.

8. The connector according to claim 7, wherein the one or more shoulders comprise a first shoulder and a second shoulder, which are disposed on the upper surface and the lower surface of the input terminal respectively and are different in shape or size, or both shape and size.

9. The connector according to claim 8, wherein each of the output terminals has an upper surface, a lower surface, a left side surface, and a right side surface, which are parallel with a direction of length L; the one or more shoulders comprise a third shoulder and a fourth shoulder, which are disposed on the upper surface and the lower surface of the output terminal respectively and are different in shape or size, or both shape and size.

10. The connector according to claim 2, wherein the input terminal is positioned on a first side of the adapting piece and the multiple output terminals being positioned on an opposite side of the adapting piece, so that the input terminal and the multiple output terminals project in different directions.

11. The connector according to claim 1, wherein the housing input plug-in interface is profiled for plug-in connection to an input mating connector, and further comprises a plurality of output plug-in interfaces profiled for mating with a like plurality of output mating connectors.

12. The connector according to claim 1, wherein the metal connection terminal is an integrally formed piece; and the metal connection terminal and the housing are an insert-molded piece.

13. The connector according to claim 1, wherein the input terminal, the output terminals and the adapting piece are each in the shape of a flat sheet; the length of the input terminal is greater than the thickness and the width of the input terminal; the length of each output terminal is greater than the thickness and the width of the output terminal; and an extending direction of the width of the input terminal and an extending direction of the width of each output terminal are the same, and are same as an extending direction of the thickness of the adapting piece.

14. The connector according to claim 13, wherein the input terminal is connected to a middle portion of the adapting piece, and the multiple output terminals are connected to two ends of the adapting piece respectively.

15. The connector according to claim 13, wherein the adapting piece has a width extending in a horizontal direction, and the input terminal and the output terminals each have a width extending in a vertical direction.

16. The connector according to claim 1, wherein the input terminal, the adapting piece and the output terminals are integrally disposed and are formed through bending; the metal connection terminal is an integral piece formed by sheet stamping; and the input terminal and the output terminals are bent relative to the adapting piece and are disposed to be perpendicular to the adapting piece.

17. The connector according to claim 16, wherein the connector comprises multiple metal connection terminals; and the respective adapting pieces of the multiple metal connection terminals are disposed to be parallel with one another; the respective input terminals of the multiple metal connection terminals have ends which are aligned; and the multiple metal connection terminals are the same.

18. The connector according to claim 1, wherein the housing is provided with two output plug-in interfaces; the connector further comprises multiple metal connection terminals each comprising one input terminal and two output terminals; and the two output terminals of each of the metal connection terminals are located in the two output plug-in interfaces respectively.

19. The connector according to claim 1, wherein the input plug-in interface and the output plug-in interfaces have same plug-in mating structure for mating with same mating connectors.

20. A cable harness assembly, comprising multiple cables and the connector according to claim 1, wherein the multiple cables are connected to the input terminal and the output terminals respectively.

21. A vehicle CAN bus connector, comprising a cable harness assembly, wherein the cable harness assembly comprises multiple cables and the connector according to claim 1; and the multiple cables are connected to the input terminal and the output terminals respectively.

* * * * *